United States Patent [19]

Eisenberg

[11] 4,387,477

[45] Jun. 14, 1983

[54] PAINT ROLLER CLEANING SYSTEM

[76] Inventor: Abraham Eisenberg, 6604 Chippewa Dr., Baltimore, Md. 21209

[21] Appl. No.: 302,314

[22] Filed: Sep. 14, 1981

[51] Int. Cl.[3] ..... B44D 3/00

[52] U.S. Cl. ..... 15/104.92; 15/104 R; 15/257.06

[58] Field of Search ..... 15/104 R, 104.92, 142, 15/241, 237, 257 R, 257.06; 206/77.1; 211/41

[56] References Cited

U.S. PATENT DOCUMENTS

| | | | |
|---|---|---|---|
| 83,413 | 10/1868 | Sawyer | 211/41 |
| 465,070 | 12/1891 | Thew | 211/41 X |
| 1,396,702 | 11/1921 | Hoffman | 15/241 |
| 2,122,583 | 7/1938 | Parizot | 15/104 R X |
| 2,945,251 | 7/1960 | Eichner | 15/104.92 |
| 3,431,574 | 3/1969 | Mathieu | 15/104.92 |

*Primary Examiner*—Edward L. Roberts

*Attorney, Agent, or Firm*—Morton J. Rosenberg

[57] ABSTRACT

A paint roller cleaning system (10) for cleaning a roller brush (12) of a paint roller (14). The paint roller cleaning system (10) includes a longitudinally extended frame member (20) having sidewalls (26, 26', 28, 28') extending around and defining a periphery of the frame member (20). An internal section (30) of frame member (20) includes a plurality of longitudinally extending helical coil members (32) which are secured to opposingly displaced sidewall members (28 and 28'), and are located adjacent each to the other in a transverse direction (24). The paint roller brush (12) is reversibly rolled over the coil members (32) in the transverse direction (24) in order to allow the bristles of the roller brush (12) to contact the coil members (32). The coil members (32) deflect in a longitudinal direction (22), a transverse direction (24), and in a vertical direction to provide a complete wiping and cleaning of the roller brush (12).

8 Claims, 3 Drawing Figures

PAINT ROLLER CLEANING SYSTEM

BACKGROUND OF THE INVENTION

1. Field of the Invention

This invention pertains to paint roller brush cleaning systems. In particular, this invention relates to the cleaning of roller brushes by a manual device. Still further, this invention pertains to a paint roller cleaning system including a frame member within which is mounted a plurality of members to contact the bristles of the brush. Further, the contacting members are displaceable in three directions, namely, a transverse direction, a longitudinal direction, and a vertical direction, to maximize the cleaning operation. More in particular, this invention relates to a paint roller cleaning system which maximizes the time effort in cleaning of a roller brush and further maintains the bristles of the roller brush in a softened condition subsequent to the cleaning operation. Additionally, this invention relates to a roller brush cleaning system which has a minimum of moving parts to aid in reliability of the system.

2. Prior Art

Paint roller cleaning systems are known in the prior art. Numerous types of prior art systems such as those showing the passage of a roller brush over perforations in a plate have been known in the prior art. However, the mere passage and contact of a roller brush over a perforated plate does not allow for the deflection of such a plate and the subsequent wiping of the roller brush bristles in three directions to maximize the cleaning operation, as provided in the subject invention concept. Additionally, other types of cleaning of roller brushes include contact of the roller brush bristles with a screen, however, once again, such contact does not provide for the subsequent cleaning and wiping action, as is provided by the invention concept.

The closest prior art known to the Applicant is U.S. Pat. No. 3,431,574 which is directed to a system for both washing and cleaning paint rollers. This system provides for a container wherein the roller brush is inserted vertically and apparently contacts opposing helical coils. However, this prior art system does not provide for the same type of contact as the invention concept, and does not allow for the displacement of the spring members in the optimized three directions, as is provided by the subject invention concept system. Additionally, this reference provides for a complicated hardware system which would be totally unacceptable in the manual usage of the elements of the subject system.

Other prior art systems for cleaning paint roller brushes include such concepts of insertion of the paint roller brush within containers which have solvent maintained therein. However, such prior art type systems do not allow for a rapid cleaning of the roller brushes, and it is clearly seen that such roller brushes must be maintained for extended periods of time within the solvent, as opposed to the subject cleaning system.

SUMMARY OF THE INVENTION

A paint roller cleaning system for cleaning a paint roller. The paint roller cleaning system includes a longitudinally extended frame member having sidewalls extending around the closed periphery thereof. The frame member has a predetermined longitudinal dimension and a predetermined transverse dimension. Further, a plurality of longitudinally extending helical coil members are secured to the frame member on opposing longitudinal ends thereof. The helical coil members are located adjacent each to the other in a transverse direction when taken with respect to the longitudinal extension.

DESCRIPTION OF THE PREFERRED EMBODIMENTS

Figure 1:
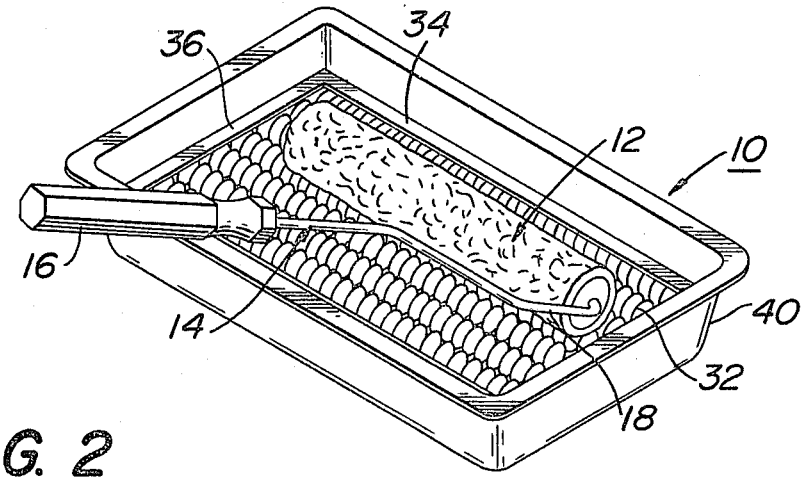
FIG. 1 is a perspective view of the paint roller cleaning system shown inserted within a receptacle during the cleaning operation.
Figure 2:
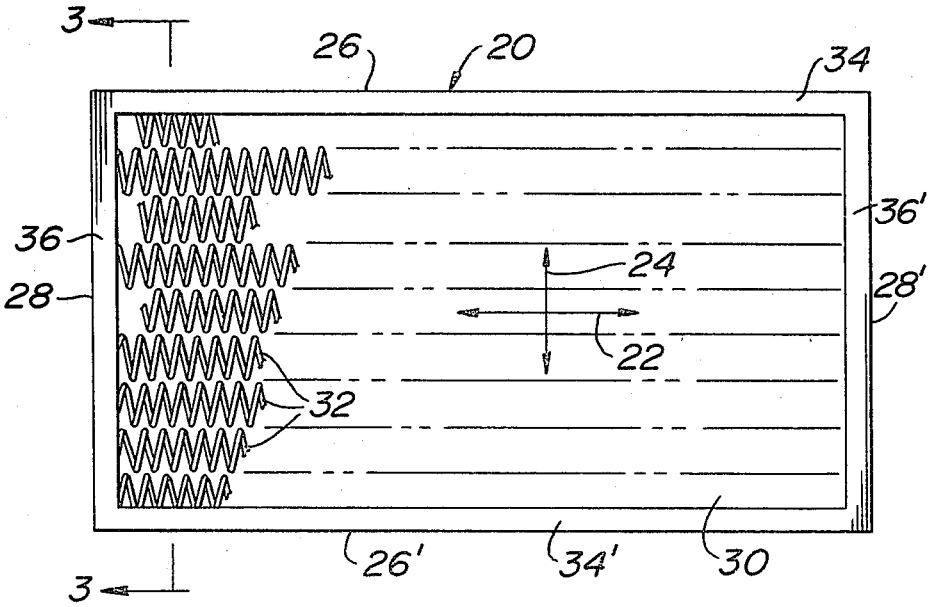
FIG. 2 is a plane view of the paint roller cleaning system showing the frame member and the plurality of helical coil members; and, FIG. 3 is a sectional view taken along the Section Lines 3—3 of FIG. 2.
Figure 3:
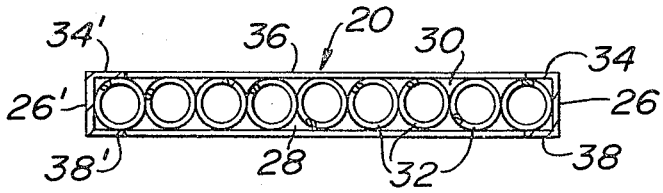

Referring now to FIGS. 1-3, there is shown paint roller cleaning system 10 for cleaning paint roller brush 12 of paint roller 14. Cleaning system 10 is generally used subsequent to a painting operation, wherein a residue of paint is left on roller brush 12. In such instances, it is necessary to remove any paint from roller brush 12 in an expedited manner in order that the individual bristles or fibers do not harden with the paint remaining thereon. Use of cleaning system 10, as will be described in following paragraphs, allows the user to substantially completely clean roller brush 12 and immediately use paint roller 14 for a subsequent application of paint of either the same color, or even a different color. Cleaning system 10 provides the user with a device which is manually actuatable and has a simplified operation concept. Further, paint roller cleaning system 10 optimizes the painting operation in that the user may apply different coats of paint of differing colors in almost a continuous operation without changing paint rollers 14 during the overall painting operation. As will be seen, the hardware concept of cleaning system 10 is of a simplified nature and the cleaning operation is manual with few moving elements and particularly, lends itself to an inexpensive hardware item which is highly reliable.

Paint roller cleaning system 10 is used for cleaning paint roller 14 which includes handle member 16 grasped by the user during the painting operation and the cleaning operation to be described. Handle member 16 is rigidly coupled to stem 18 which is rotationally coupled to paint roller brush 12. Paint roller 14 may be one of a number of commercially available types of systems now found in the commercial marketplace. Paint roller brush 12 is also available in the commercial marketplace, and as is known, comprises a cylindrical member having a through opening wherein the external sidewalls of brush 12 is formed of a plurality of fibrous members which may be formed of a number of different types of materials, such as nylon, plastic-like compositions, cloth fibers, or some like material compositions.

Paint roller cleaning system 10 includes frame member 20 shown in FIGS. 2 and 3, extending in longitudinal direction 22. Longitudinal and transverse directions are defined by directional arrows 22 and 24, shown in FIG. 2. Frame member 20 includes transversely displaced sidewalls 26 and 26', as well as longitudinally opposed sidewalls 28 and 28'. Sidewalls 26, 26', 28, 28' define a closed periphery of frame member 20 which may be rectangular in contour. Additionally, sidewalls 26, 26', 28 and 28' extend in a vertical direction defined as a normal direction to the plane defined by longitudinal and transverse directional arrow planes 22 and 24. The closed periphery defined by sidewalls 26, 26', 28, 28' describes a frame member internal portion 30 which has both a predetermined longitudinal dimension and a predetermined transverse dimension. Internal portion 30 has a predetermined dimension in longitudinal direction 22 of sufficient size so as to accomodate the longitudinal dimension of paint roller brush 12. Paint roller brushes 12 generally are commercially available in eight inch, ten inch, and twelve inch sizes. Internal portion 30 of longitudinal extensions are of sufficient size so as to be equal to or greater than the longitudinal dimension of a particular roller brush 12 being used.

Sidewalls 26, 26', 28, and 28' may be fixedly secured each to the other in any one of a number of manners such as bolting, welding, or even formed in one-piece formation. Additionally, frame member 20 is formed of a composition such as steel, aluminum, or some like metal which will be able to accomodate the forces applied thereto as well as to remain substantially inert with respect to the environments encountered.

As is seen in FIGS. 1–3, cleaning system 10 includes a plurality of longitudinally extending helical coil members 32. Helical coil members 32 are secured to frame member 20 on opposing longitudinal ends thereof in substantially fixed relation thereto. Coil members 32 are located adjacent each to the other, as is shown in transverse direction 24. Additionally, coil members 32 are free to move each with respect to the other, in other words, although coil members 32 are fixedly secured to frame member 20 on opposing longitudinal ends thereof, such helical coil members 32 are generally not fixedly secured each to the other. Helical coil members 32 are formed of a steel type composition and are of sufficient diameter so as to allow flexibility and displaceability, responsive to contact by paint roller brush 12 while simultaneously providing sufficient structural integrity so as not to be permanently deformed responsive to the force loading. Although a number of different types of helical coil members 32 may be used, one particular set of parameters which has successfully been used is a spring steel composition having a pitch between individual coils of approximately 0.5 inches with a mean diameter of the coil approximating 1.0 inches and the wire diameter approximating 0.125 inches.

As can be seen in FIG. 3, the plurality of helical coil members 32 are mounted in substantially planar relation each with respect to the other. Additionally, each of helical coil members 32 are positionally located in a substantially contiguous manner to a next successive helical coil member 32. Although not totally necessary to the subject invention concept, it is clearly seen in FIG. 2 that frame member 20 generally defines a rectangular contour when a top view is taken. This general type of contour allows for simplified placement of helical coil members 32, and generally aids in simplifying and providing economy in the manufacture of cleaning system 10. Additionally, the opposing ends of helical coil members 32 may be fixedly secured to frame member 20 through a number of well-known techniques, such as welding, bolting, insert of helical coil member ends within openings formed in sidewalls 28 and 28', or other like fixed securement means, not important to the inventive concept as herein described.

Of importance to cleaning system 10 are upper transversely opposed flange members 34, 34' and upper longitudinally opposed flange members 36 and 36', as shown in FIGS. 2 and 3. Opposed upper flange members 34, 34', 36, 36' extend inwardly of respective sidewalls 26, 26', 28, 28' into frame member internal portion 30, as is shown. Additionally, upper flange members 34, 34', 36, 36' extend around the periphery of frame member 20. Upper flange members 34, 34', 36, 36' may be individual in nature or formed in one-piece formation, and secured individually to a respective sidewall, or formed in one-piece formation with respect to all of the sidewalls. Transversely opposed flange members 34 and 34' extend over a portion of one of helical coil members 32, which are located adjacent sidewalls 26 and 26', respectively. The extension in a transverse direction of flange members 34 and 34' may approximate 0.5 inches, and serve the purpose of providing a wiping surface at the end of the rolling action of roller brush 12 over other helical coil members 32 within section 30 of frame member 20. Additionally, it has been found unexpectedly, that without opposed flange members 34 and 34', the cleaning action of system 10 is degraded to some extent in that it is believed too much deflection is allowed between adjacent helical coil members 32. Thus, the capturing of helical coil members 32 at the opposing transverse ends defined by opposing transverse sidewalls 26 and 26' allows for additional structural integrity of helical coil members 32 while maintaining a deflection amount whiich optimizes the cleaning action of helical coil members 32.

It has been found to be important that helical coil members 32 are flexibly displaceable in transverse direction 24, longitudinal direction 22, as well as the vertical direction when taken with respect to the plane defined by the directional arrows 22 and 24. Thus, it is important that when paint roller brush 12 is rolled over helical coil members 32, that there be three separate and distinct displacements of coil members 32 in order to optimize the cleaning action. In order to further capture coil members 32 and further to provide for displacement in the vertical direction, lower transversely displaced flange members 38 and 38' are provided as is seen in FIG. 3.

Lower transversely opposed flange members 38 and 38' extend generally for the same distance into section 30, as upper transversely opposed flange members 34 and 34'. The purpose of lower transversely opposed flange members 38 and 38' is generally twofold in nature, wherein coil members 32 which are transversely opposed are partially captured between flange members 34', 38', and 34, 38. Of more importance, the location of lower transversely opposed flange members 38 and 38' allows for vertical movement of helical coil members 32 within frame member 20. It must be understood that frame member 20 is placed on a base surface when the cleaning action is to be done and thus, even the small vertical displacements of the coil members defined by the thickness of longitudinally transversely opposed flange members 38 and 38' allows for a very slight vertical deflection which is sufficient to aid in the cleaning process. It must be further understood that a large deflection does not have to occur, since the fibers on brush 12 are generally only approximately 0.0625 inches in depth. Thus, opposed flange members 38 and 38' essentially allow coil members 32 within section 30 of frame member 20 to bounce in the vertical direction. Generally, all of the flange members as herein defined and described may be formed of the same composition material as sidewalls 26, 26', 28, and 28'.

In operation, frame member 20 is inserted into receptacle 40, as is shown in FIG. 1. Receptacle 40 may be any standard size type of open container with an opening dimension greater than the peripheral dimension of frame member 20. A solvent, generally being a paint solvent such as Benzene, or Turpentine, or other like composition, is poured or otherwise inserted into receptacle 40 to a depth approximating the vertical height of frame member 20. Subsequent to a painting operation, the user grasps handle member 16 and forceably deflects helical coil members 32 by application of a downward force and rolls paint roller 14 over helical coil members 32. At the end of a transverse displacement of paint roller brush 12, opposing flange members 34 and 34' provide a wiping action for the cleaning process. In this manner, after a few passes of roller brush 12 over coil members 32, it is seen that the fibers become substantially returned to their initial color. Additionally, it has been found that even when the paint roller 14 is mounted in the ambient environment over a period of time, that the fibers remain softened and do not harden. It is believed that the displacement in transverse direction 24, longitudinal direction 22, and the vertical direction, provides for a complete wiping and discharge of the paint contained on roller brush 12.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A paint roller cleaning system for cleaning a paint roller, comprising:

(a) a longitudinally extended frame member having sidewalls extending around a closed periphery thereof, said frame member having a predetermined longitudinal dimension and a predetermined transverse dimension;

(b) a plurality of longitudinally extending helical coil members secured to said frame member on opposing longitudinal ends thereof, said helical coil members being located adjacent each to the other in a transverse direction when taken with respect to said longitudinal direction where said helical coil members are flexibly displaceable in (1) said transverse direction, (2) said longitudinal direction, and (3) a vertical direction when contacted by said paint roller being rolled over said helical coil members in a reciprocal transverse direction; and, (c) a receptacle adapted to contain fluid, said frame member being insertable within said receptacle for contacting said helical coil members with said paint roller for removal of contaminants contained thereon.

2. The paint roller cleaning system as recited in claim 1 where said plurality of said helical coil members are positionally mounted in substantially planar relation with respect to each other, each of said helical coil members being substantially contiguous to a next successive helical coil member.

3. The paint roller cleaning system as recited in claim 1 where said frame member is substantially rectangular in contour.

4. The paint roller cleaning system as recited in claim 2 where said frame member includes a flange member extending inward of said sidewalls throughout said periphery of said frame member, said flange member extending over a portion of one of said helical coil members located adjacent said sidewalls.

5. The paint roller cleaning system as recited in claim 2 where said transverse dimension of said plurality of helical coil members is at least equal to a circumferential dimension of said paint roller.

6. The paint roller cleaning system as recited in claim 2 where each of said helical coil members is welded to said frame member on opposing ends of said helical coil members.

7. The paint roller cleaning system as recited in claim 6 including a paint solvent inserted into said receptacle for at least partially covering said frame member.

8. The paint roller cleaning system as recited in claim 6 where said frame member includes a pair of flange members extending inward of said sidewalls throughout said periphery of said frame member, one of said flange members secured to an upper portion of said sidewalls and said other flange member secured to a lower portion of said sidewalls.

* * * * *